US009777605B2

(12) United States Patent
Sato et al.

(10) Patent No.: US 9,777,605 B2
(45) Date of Patent: Oct. 3, 2017

(54) MOTOR CONTROL APPARATUS

(71) Applicant: DENSO CORPORATION, Kariya, Aichi-pref. (JP)

(72) Inventors: Masatake Sato, Kariya (JP); Yoshifumi Kishimoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/000,334

(22) Filed: Jan. 19, 2016

(65) Prior Publication Data

US 2016/0215662 A1 Jul. 28, 2016

(30) Foreign Application Priority Data

Jan. 23, 2015 (JP) ..... 2015-11465

(51) Int. Cl.
*F01L 1/34* (2006.01)
*F01L 1/352* (2006.01)

(52) U.S. Cl.
CPC ..... *F01L 1/352* (2013.01); *F01L 2201/00* (2013.01); *F01L 2250/02* (2013.01); *F01L 2820/032* (2013.01)

(58) Field of Classification Search
CPC ... F01L 1/352; F01L 2201/00; F01L 2250/02; F01L 2820/032
USPC ..... 123/90.17
See application file for complete search history.

(56) References Cited

U.S. PATENT DOCUMENTS

2005/0235937 A1* 10/2005 Tani ..... F01L 1/352 123/90.17
2009/0058344 A1 3/2009 Morino
2011/0290205 A1 12/2011 Kozawa et al.

FOREIGN PATENT DOCUMENTS

JP H10-337073 A 12/1998

* cited by examiner

*Primary Examiner* — Zelalem Eshete
(74) *Attorney, Agent, or Firm* — Posz Law Group, PLC

(57) ABSTRACT

A motor control apparatus for adjusting a cam phase includes a motor control part, which controls a current supplied to a stator coil by controlling plural switching elements forming an inverter to turn on and off. The motor control part stops the current supplied to the stator coil each time a motor rotates a predetermined rotation angle interval in a power generation control mode, in which a rotation torque is generated in a direction to impede the motor rotation. The motor control part maintains the power generation control mode when a rotation signal is determined as varying in a predetermined time period. The motor control part switches over an operation mode to a normal control mode to generate a rotation torque in a direction to promote the motor rotation when the rotation signal is determined as not varying in the predetermined time period.

2 Claims, 13 Drawing Sheets

FIG. 6

| | T1 | T2 | T3 | T4 | T5 | T6 |
|---|---|---|---|---|---|---|
| U SIGNAL | Hi | Hi | Hi | Lo | Lo | Lo |
| V SIGNAL | Lo | Lo | Hi | Hi | Hi | Lo |
| W SIGNAL | Hi | Lo | Lo | Lo | Hi | Hi |
| RA [° ] | 0-60 | 60-120 | 120-180 | 180-240 | 240-300 | 300-360 |

NORMAL ROTATION →

← REVERSE ROTATION

FIG. 7

| | T1 | T2 | T3 | T4 | T5 | T6 |
|---|---|---|---|---|---|---|
| RA [° ] | 0-60 | 60-120 | 120-180 | 180-240 | 240-300 | 300-360 |
| U HIGH SW | Hi | Hi | Lo | Lo | Lo | Lo |
| V HIGH SW | Lo | Lo | Hi | Hi | Lo | Lo |
| W HIGH SW | Lo | Lo | Lo | Lo | Hi | Hi |
| U LOW SW | Lo | Lo | Lo | Hi | Hi | Lo |
| V LOW SW | Hi | Lo | Lo | Lo | Lo | Hi |
| W LOW SW | Lo | Hi | Hi | Lo | Lo | Lo |

FIG. 9

| | T7 | T8 | T9 | T10 | T11 | T12 |
|---|---|---|---|---|---|---|
| RA [° ] | 0-60 | 60-120 | 120-180 | 180-240 | 240-300 | 300-360 |
| U HIGH SW | Hi | Lo | Lo | Lo | Lo | Lo |
| V HIGH SW | Lo | Lo | Hi | Lo | Lo | Lo |
| W HIGH SW | Lo | Lo | Lo | Lo | Hi | Lo |
| U LOW SW | Lo | Lo | Lo | Hi | Hi | Lo |
| V LOW SW | Hi | Lo | Lo | Lo | Lo | Hi |
| W LOW SW | Lo | Hi | Hi | Lo | Lo | Lo |

MOTOR CONTROL APPARATUS

CROSS REFERENCE TO RELATED APPLICATION

The present application is based on and incorporates herein by reference Japanese patent application No. 2015-11465 filed on Jan. 23, 2015, the whole contents of which are incorporated herein by reference.

FIELD

The present disclosure relates to a motor control apparatus, which adjusts a phase of a camshaft relative to a crankshaft by controlling driving of a motor mechanically coupled to the crankshaft and the camshaft through a valve timing conversion unit.

BACKGROUND

A conventional valve timing adjusting apparatus, which adjusts a valve timing of intake valves of an internal combustion engine, is disclosed in patent document, JP 2009-62837 A (US 2009-0058344 A1). This valve timing adjusting apparatus includes an electric motor and plural switching elements. The motor is formed of a rotor part, to which a motor shaft is fixed, and a stator coil provided around the rotor part. The switching elements are connected to the stator coil. The valve timing adjusting apparatus further includes a power supply driving part and a phase adjusting mechanism. The power supply driving part switches over switching elements, which are selected to be tuned on at every angular rotation interval of the motor shaft. The phase adjusting mechanism adjusts a relative phase between a crankshaft and a camshaft of the internal combustion engine in accordance with operation states of the internal combustion engine and a rotation of the motor shaft.

When the motor shaft rotates under a state that a current flows in the stator coil and the stator coil generates a magnetic field, an induced voltage is generated in the stator coil. In a case that a target rotation direction of the motor shaft is the same as an actual rotation direction of the motor shaft, the induced voltage is generated in a direction opposite to a voltage supplied to the stator coil by the selected switching elements, which are turned on. As a result, a current flows in the selected switching elements, which are in the on-states, in correspondence to a difference between the supplied voltage and the induced voltage. However, in a case that the target rotation direction of the motor shaft is different from, that is, opposite to the actual rotation direction of the motor shaft, the induced voltage is generated in the same direction as the voltage supplied to the stator coil by the switching elements, which are turned on. As a result, large current flows in the selected switching elements in correspondence to a sum of the supplied voltage and the induced voltage. This large current is likely to generate heat excessively.

According to the valve timing adjusting apparatus disclosed in the patent document, in a case that the target rotation direction of the motor shaft is the same as the actual rotation direction of the motor shaft, the power supply driving part sets an entire range of rotation angle of the motor shaft, which corresponds to 30° in mechanical angle (12° in electrical angle), as an on-state range, in which the selected elements are turned on continuously. In a case that the target rotation direction and the actual rotation direction are different, the power supply driving apart sets the rotation angle range by dividing it into the on-state range and an off-state range, in which the selected elements are turned off continuously. Thus, the voltage is supplied to the stator coil in the on-state range but not supplied in the off-state range. As a result, a period of time, in which the current corresponding to the sum of the supplied voltage and the induced voltage, is shortened thereby to suppress excessive heat generation of the selected elements.

In one exemplary valve timing adjusting apparatus according to the patent document, the motor is mechanically coupled to the crankshaft through the phase adjusting mechanism. When the crankshaft is in rotation as a result of combustion in the internal combustion engine, the motor shaft of the motor also rotates irrespective of a control torque (rotation torque) generated by the power supply to the stator coil. Even when the crankshaft continues to rotate by inertia after stopping of the combustion, the motor shaft continues to rotate in the same direction as the crankshaft rotates while decreasing its rotation speed. The rotor part fixed to the motor shaft has permanent magnets. Since metallic parts such as the stator coil are present around the permanent magnets, magnetic force is generated between the metallic parts and the permanent magnets. This magnetic force exerts on the motor shaft as a braking torque, which impedes rotation of the rotor part.

When the motor shaft rotates with the crankshaft by inertia and its rotation force decreases closely to a stop, the braking torque tends to reverse the rotation direction of the motor shaft momentarily before stopping. When the rotation direction is reversed before stopping as described above, the power supply driving part erroneously determines that the actual rotation direction is different from the target rotation direction and stops its operation. The power supply driving part thus sets the rotation angle range by dividing it into the on-state range and the off-state range, when the target rotation direction and the actual rotation direction are different. When the rotation angle of the motor shaft at the time of motor stopping is in the on-state range, the power supply driving part can drive the motor to generate the rotation torque of the motor shaft at the time of restarting the internal combustion engine. By thus rotating the motor shaft, the phase of the camshaft relative to the crankshaft can be adjusted to a phase, at which a quantity of air compressed in a combustion chamber formed by a cylinder and a piston becomes suitable for restarting the internal combustion engine. When the rotation angle of the motor shaft at the time of motor stopping is in the off-state range, the power supply driving part cannot drive the motor to generate the rotation torque of the motor shaft at the time of restarting of the internal combustion engine. Since the motor shaft cannot be rotated, the phase of the camshaft relative to the crankshaft cannot be adjusted to a phase, which is suitable for restarting the internal combustion engine.

In the other exemplary valve timing adjusting apparatus of different configuration according to the patent document, the power supply driving part sets the entire range of variation, in which the rotation angle range is varied in an advanced direction or retarded direction by a mechanical angle of 15° (electrical angle of 60°), as the on-state range, when the target rotation direction and the actual rotation direction are different. By this setting, the induced voltage generated by the stator coil is decreased and the current corresponding to the sum of the supplied voltage and the induced voltage is decreased. Thus, the excessive heat generation of the selected element is suppressed. In the other exemplary motor control apparatus, the current flows in the stator coil continuously irrespective of the rotation angle range even when the target rotation direction and the actual rotation direction are different. As a result, the motor can be restarted.

In the other exemplary motor control apparatus, differently from the exemplary motor control apparatus, the current corresponding to the sum of the supplied voltage and the induced voltage flows continuously although decreased, when the target rotation direction and the actual rotation direction are different. As a result, suppression of the heat generation of the selected element is limited.

SUMMARY

The present disclosure addresses the above-described problem and has an object to provide a motor control apparatus, which suppresses excessive heat generation of switching elements and drives a motor to generate a rotation torque at a time of restarting irrespective of a rotation angle, at which the motor stops.

According to one aspect, a motor control apparatus is provided for controlling driving of a motor, which is coupled mechanically to a crankshaft and a camshaft of an internal combustion engine through a valve timing conversion unit to adjust a phase of the camshaft relative to the crankshaft. The motor includes an output shaft coupled to the valve timing conversion unit, a rotor fixed to the output shaft and having permanent magnets and a stator provided around the rotor and having a stator coil. The motor control apparatus comprises an inverter, a rotation angle detection part, a motor control part and a command part. The inverter includes plural switching elements for supplying a current to the stator coil to generate magnetic fluxes, which exert on the permanent magnets to generate a rotation torque in the rotor in a direction to promote or impede rotation of the output shaft. The rotation angle detection part generates a rotation signal varying with a rotation angle of the motor and a rotation direction of the motor. The motor control part controls the plural switching elements of the inverter to turn on and off based on the rotation signal thereby to control the current flowing in the stator coil and control generation of the rotation torque. The command part commands the motor control part to increase and decrease the rotation torque.

The motor control part is configured to operate in a normal control mode when the rotation torque is commanded to promote the rotation of the motor, and a power generation control mode when the rotation torque is commanded to impede the rotation of the motor. The motor control part is configured to supply the current to the stator coil always irrespective of the rotation angle of the motor in the normal control mode, and stop the current from being supplied to the stator coil at every rotation of the motor over a predetermined rotation angular interval in the power generation control mode. The motor control part is configured to check whether the rotation signal varies in a predetermined time period in the power generation control mode, maintains the power generation control mode upon determination that the rotation signal varies in the predetermined time period, and switches over the operation mode to the normal control mode upon determination that the rotation signal does not vary in the predetermined time period.

BRIEF DESCRIPTION OF THE DRAWINGS

FIG. 6 is a table showing a relation between the sensor signal and a rotation angle of the motor;

FIG. 7 is a tale showing a relation between the rotation angle and the control signal under normal control;

FIG. 9 is a table showing a relation between the rotation angle and the control signal under power generation control;

EMBODIMENT

Figure 1:
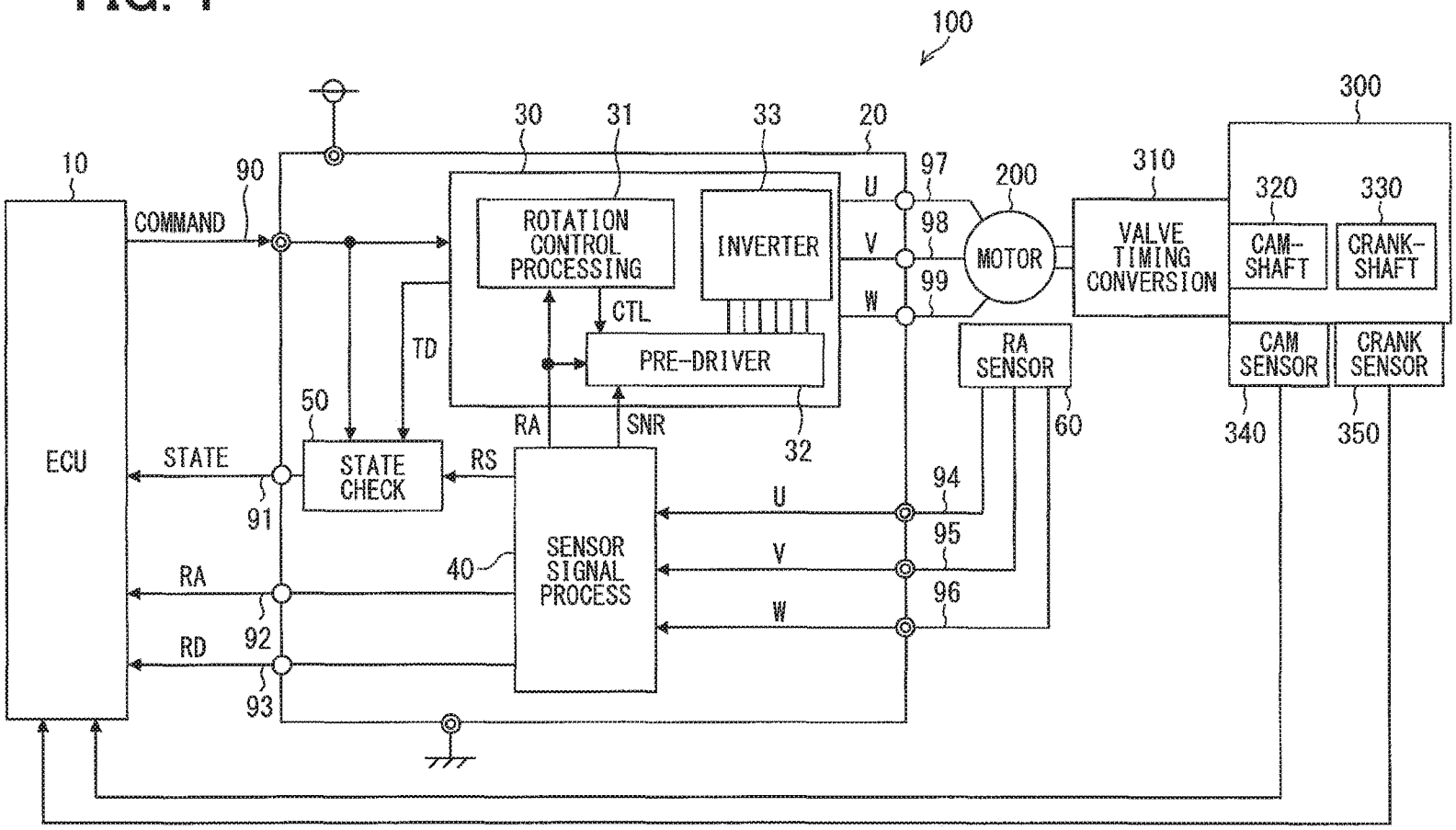
FIG. 1 is a block diagram showing a general configuration of a motor control apparatus according to a first embodiment.

A motor control apparatus according to one present embodiment will be described with reference to FIG. 1 to FIG. 16. In FIG. 1, in addition to a motor control apparatus 100, a motor 200, an internal combustion engine 300, a valve timing conversion part 310, a cam angle sensor 340 and a crank angle sensor 350 are shown. In FIG. 2, FIG. 3, FIG. 12 and FIG. 13, electrical angles, which will be described later, are shown in brackets and a rotation angle sensor 60 is shown with dots. In FIG. 13, for simplicity of illustrations, no reference signs are assigned and one of N-poles of permanent magnets 212 described later is illustrated with hatching to show its rotation.

The motor control apparatus 100 is configured to control a phase difference (referred to as a cam phase below) between phases of a camshaft 320 and a crankshaft 330 of the internal combustion engine 300 by controlling rotation of the motor 200. As shown in FIG. 1, the motor control apparatus 100 is connected to the motor 200 electrically through three stator lines 97, 98 and 99. The motor 200 is coupled to the internal combustion engine 300 mechanically through the valve timing conversion part 310. The motor control apparatus 100 will be described in detail following the description of the motor 200, the valve timing conversion part 310 and the internal combustion engine 300.

Figure 2:
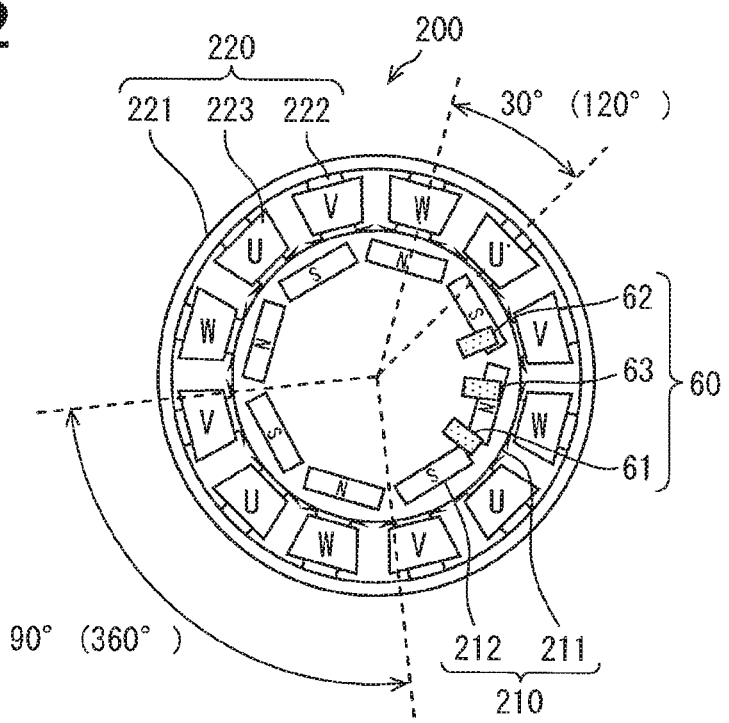
FIG. 2 is a sectional view showing a general configuration of a motor.

As shown in FIG. 2, the motor 200 includes a rotor 210, which is fixed to an output shaft of the motor 200, and a stator 220, which is provided around the rotor 210. The rotor 210 is formed of a cylindrical iron core 211 and plural (eight, for example) permanent magnets 212 fitted in the iron core 211. The permanent magnets 212 are arranged equi-angularly around a central axis of the iron core 211 such that respective N-poles and S-poles alternate in a circumferential direction. The N-pole and the S-pole, which are adjacent to each other, are located at an angular interval of 45° in the circumferential direction. The magnetic fluxes generated by the permanent magnets 212 periodically changes at every angular rotation of 90° of the rotor 210. A mechanical angle 90° corresponds to an electrical angle 360°. The magnetic flux generated by the permanent magnet 212 is detected by the rotation angle sensor 60 as described later.

Figure 4:
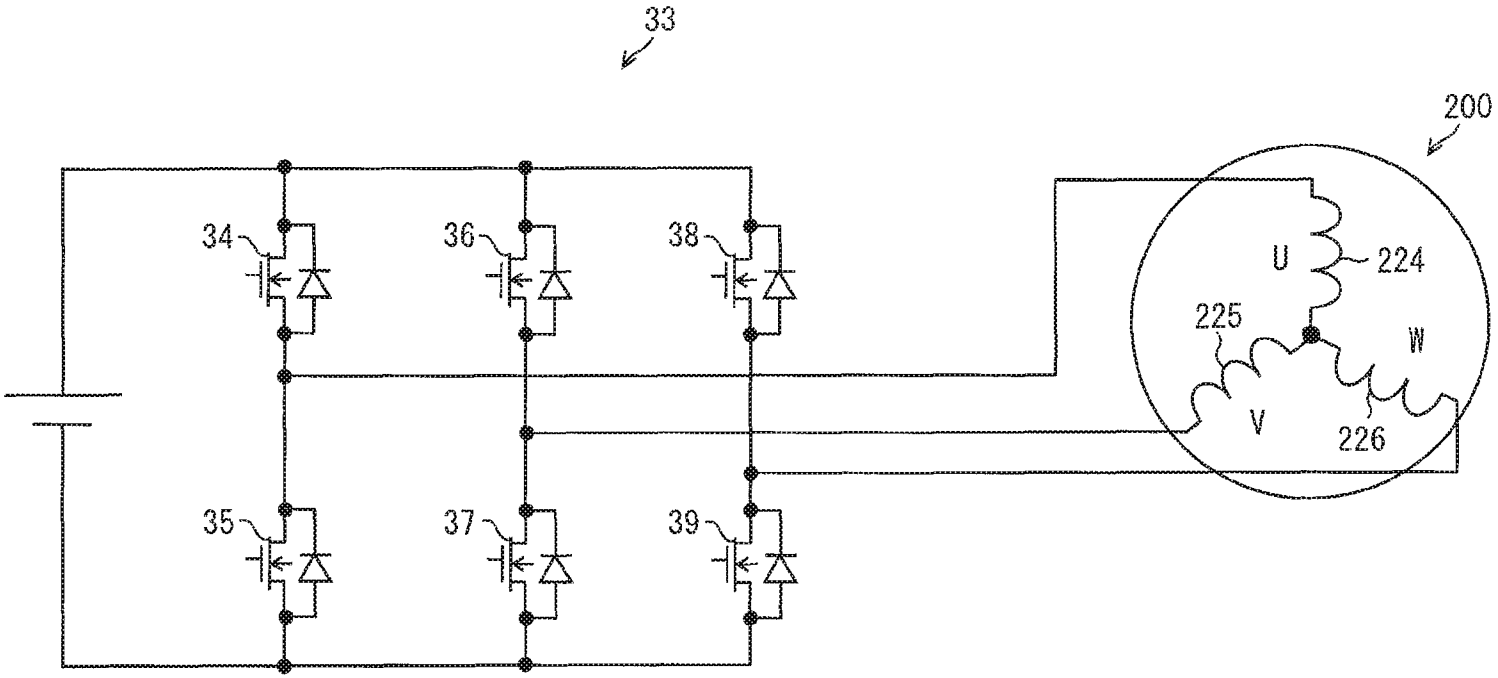
FIG. 4 is a circuit diagram showing a general configuration of an inverter and a stator coil of the motor.

The stator 220 is formed of a cylindrical casing 221, salient poles 222 provided on an inner periphery of the casing 221 and a stator coil 223 wound about the salient poles 222. Twelve salient poles 222 are arranged equiangularly on the inner peripheral surface of the casing 221. Two salient poles 222 adjacent each other are located at an angular interval of 30° about the central axis of the rotor 210 in the circumferential direction. The stator coil 223 includes, as shown in FIG. 4, a U-phase stator coil 224, a V-phase stator coil 225 and a W-phase stator coil 226. The U-phase stator coil 224, the V-phase stator coil 225 and the W-phase stator coil 226 are wound about twelve salient poles 222 in sequential order. Each of phase coils 224, 225 and 226 is wound about four salient poles 222, each of which is angularly spaced 90° from the adjacent one of the same phase. The stator coils 224 to 226 are Y-connected as shown in FIG. 4. Each stator coil 224 to 226 is connected to a mid-point between two switches of an inverter 33. As described later, when switches 34 and 37 shown in FIG. 4 turn on, for example, the stator coils 224 and 225 are connected to a positive terminal and a negative terminal of a power supply source such as a battery, respectively, to allow a current to flow in the stator coils 224 and 225. With this current, the stator coils 224 and 225 generate respective fluxes, which exert on the permanent magnets 212 of the rotor 210 and generate a rotation torque in the rotor 210. Thus the output shaft of the motor 200 rotates.

The output shaft of the motor 200 is coupled to the camshaft 320 through the valve timing conversion part 310. The valve timing conversion part 310 is coupled to the crankshaft 330 through a chain. When the internal combustion engine 300 starts to operate to rotate the crankshaft 330, the camshaft 320 and the output shaft of the motor 200 also start to rotate together with the valve timing conversion part 310. With this rotation, a cam lobe provided on a cam journal of the camshaft 320 rotates. With rotation of the cam lobe, an intake valve and an exhaust valve move up and down relative to a combustion chamber so that the intake valve allows air-fuel mixture to be suctioned into a combustion chamber and the exhaust valve allows combusted mixture to be exhausted from the combustion chamber.

In a case that the internal combustion engine 300 is a four-cycle engine, the cam lobes of the camshaft 320 corresponding to the intake valve and the exhaust valve make one rotation in two rotations of the crankshaft 330. Normally, the phases of the intake valve and the exhaust valve are shifted by an angle of about 180° calculated in terms of rotation angle of the camshaft 320. This phase difference is variable by controlling the cam phase by the motor control apparatus 100, the motor 200 and the valve timing conversion part 310.

Although not shown, the valve timing conversion part 310 includes a planetary gear mechanism, which transfers the rotation torque of the crankshaft 330, which is transferred via the chain, to the camshaft 320 and rotates the camshaft 320 relative to the crankshaft 330. The valve timing conversion part 310 includes a ring gear, to which the chain is coupled, and a disk-shaped pinion gear and a valve gear, which are provided in the ring gear. The ring gear is coupled to the crankshaft 330 through the chain and the valve gear is coupled to the camshaft 320. The pinion gear is coupled to the output shaft of the motor 200. The inside surface of the ring gear is toothed. The outside surfaces of the pinion gear and the valve gear are also toothed. Teeth formed on the inside surface of the ring gear and teeth of the pinion gear are meshed. The teeth of the pinion gear and teeth of the valve gear are meshed. Thus, when the crankshaft 330 rotates, the chain transfers this rotation to the ring gear thereby to rotate the ring gear. The pinion gear revolves about the periphery of the valve gear thereby to rotate the valve gear. As a result, the camshaft 320 rotates with the crankshaft 330.

For maintaining the phase difference of the camshaft 320 (cam phase) relative to the crankshaft 330, the motor control apparatus 100 causes the pinion gear not to rotate itself but revolve around the valve gear by the motor 200. The valve gear and the ring gear are thus rotated at the same speed. However, for advancing or retarding an angle of the cam phase, the motor control apparatus 100 causes the pinion gear to rotate itself and revolve around the valve gear by the motor 200. The valve gear is thus rotated relative to the ring gear. When the output shaft of the motor 200 rotates at higher speeds than the crankshaft 330, the cam phase is advanced. When the output shaft of the motor 200 rotates at lower speeds than the crankshaft 330, the cam phase is retarded. When the cam phase reaches a target phase by advancement or retardation, the output shaft of the motor 200 is rotated at the same speed as the ring gear. Thus the adjusted cam phase is maintained. The motor 200 thus adjusts an intake timing and an exhaust timing by the cam phase control.

As shown in FIG. 1, the motor 60 is provided with the rotation angle sensor 60 and the internal combustion engine 300 is provided with the cam angle sensor 340 and the crank angle sensor 350. The rotation angle sensor 60 outputs a detection signal indicating a rotation-state of the motor 200. The cam angle sensor 340 and the crank angle sensor 350 detect rotation angles of the camshaft 320 and the crankshaft 330, respectively. The motor control apparatus 100 calculates a rotation angle of the motor 200 based on the detection signal of the rotation angle sensor 60 and calculates a rotation speed of the internal combustion engine 300 based on the rotation angles of the camshaft 320 and the crankshaft 330. The motor control apparatus 100 controls the motor 200 based on the calculated rotation speed of the internal combustion engine 300 and the rotation angle of the motor 200. The motor control apparatus 100 thus performs the cam phase control.

For the cam phase control, the target cam phase need be calculated. This target cam phase is calculated by the motor control apparatus 100 based on output signals of various sensors, which indicate travel state of a vehicle, such as an accelerator sensor for detecting an accelerator operation position of a user and an airflow meter for measuring a quantity of air supplied to the internal combustion engine 300. The motor control apparatus 100 will be described in more detail below.

As shown in FIG. 1, the motor control apparatus 100 includes an electronic control unit (ECU) 10, a driver 20 and the rotation angle sensor 60. The electronic control unit 10 is configured to output a command signal, which includes a target rotation speed of the motor 200, to the driver 20. The driver 20 is configured to control the motor 200 based on the command signal and the detection signal of the rotation angle sensor 60. The rotation angle sensor 60 is configured to generate the detection signal corresponding to the rotation of the motor 200 and outputs it to the driver 20. The electronic control unit 10 and the driver 20 are connected electrically through four signal lines 90, 91, 92 and 93. The driver 20 and the rotation angle sensor 60 are connected electrically through three sensor lines 94, 95 and 96.

The electronic control unit 10 is configured to determine the target rotation speed of the motor 200 based on the various sensor signals indicating the vehicle travel state, the rotation speed of the engine as well as a rotation angle signal and a rotation direction signal outputted from the driver 20. The electronic control unit 10 calculates the target cam phase, which matches the travel state of the vehicle, based on the various sensor signals. The electronic control unit 10 calculates the rotation speed of the motor 200 for attaining the target cam phase and outputs the command signal, which includes the calculated rotation speed, to the driver 20. The electronic control unit 10 always sets the rotation speed, which is included in the command signal, to a finite value. When the engine stops its combustion operation, the electronic control unit 10 includes in the command signal the finite rotation speed and a command for causing the driver 20 to stop generation of rotation torque.

As shown in FIG. 1, the driver 20 includes a motor control part 30, a sensor signal processing part 40 and a state check part 50. The motor control part 30 is configured to control the rotation of the motor 200 based on the command signal inputted from the electronic control unit 10 as well as the rotation angle signal and the sensor signals inputted from the sensor signal processing part 40. The motor control part 30 supplies a rotation current to three-phase stator coils 224 to 226 of the motor 200 to rotate the rotor 210 so that the output shaft of the motor 200 rotates by itself. The sensor signal processing part 40 is configured to generate a sensor signal SNR, a rotation angle signal RA and a rotation direction signal RD in digital forms and rotation speed signal RS based on analog signals inputted from the rotation angle sensor 60. The state check part 50 is configured to generate a state signal, which will be described later. The command signal, the rotation speed signal and a torque direction signal TD are inputted to the state check part 50. Although not shown, the motor control apparatus 100 includes a current sensor, which detects the rotation current. The detection signal of the current sensor is inputted to the state check part 50.

When the command signal is inputted to the motor control part 30 from the electronic control unit 10, the motor control part 30 supplies the rotation current so that the rotation speed of the output shaft of the motor 200 attains a target rotation speed included in the command signal. The motor control part 30 thus advances, retards or maintains the cam phase. However, when the internal combustion engine 300 stops its combustion operation and the command signal includes the command for stopping the generation of rotation torque, the motor control part 30 supplies no rotation current to the three-phase stator coils 224 to 226. In this case, the output shaft of the motor 200 is driven to rotate by the crankshaft 330 and the camshaft 320. The planetary gear mechanism has stoppers, which limit the cam phase to the most retarded angle and the most advanced angle, respectively. When the output shaft of the motor 200 is driven to rotate by the crankshaft 330, the cam phase becomes most retarded.

As shown in FIG. 1, the motor control part 30 includes a rotation control processing part 31, a pre-driver 32 and an inverter 33. The rotation control processing part 31 calculates an increase or decrease direction of the rotation torque based on the target rotation speed included in the command signal and a present rotation speed detected from the rotation speed signal described later. When the present rotation speed is lower than the target rotation speed, the rotation control processing part 31 determines to increase the rotation speed by setting the rotation torque increase or decrease direction in a direction to promote the rotation of the motor 200. When the present rotation speed is higher than the target rotation speed, the rotation control processing part 31 determines to decrease the rotation speed by setting the rotation torque increase or decrease direction in a direction to impede the rotation of the motor 200. The rotation control processing part 31 outputs control information CTL, which includes the rotation torque increase or decrease direction, to the pre-driver 32. The rotation control processing part 31 thus forms a command unit.

The pre-driver 32 includes a logic circuit, which performs logic processing, and an analog circuit in the present embodiment. The logic circuit may be replaced with a microcomputer. The pre-driver 32 is configured to control the inverter 33 based on the control information inputted from the rotation control processing part 31 as well as the rotation speed signal RS and the sensor signal SNR inputted from the sensor signal processing part 40. The pre-driver 32 detects the present rotation direction (actual rotation direction) of the rotor 210 based on the sensor signal described later and compares this detected actual rotation direction with the rotation torque increase or decrease direction (torque direction) included in the control information. The pre-driver 32 operates in a normal control mode when the actual rotation direction and the torque direction coincide (that is, in the direction to promote rotation). The pre-driver 32 operates in a power generation control mode when the actual rotation direction and the torque direction differ (that is, in the direction to impede rotation). In the normal control mode, the pre-driver 32 promotes the rotation of the output shaft of the motor 200 to increase the rotation speed by controlling driving of the inverter 33 to generate the rotation torque in the rotation direction of the output shaft of the motor 200. In the power generation control mode, the pre-driver 32 impedes the rotation of the output shaft of the motor 200 to decrease the rotation speed by controlling driving of the inverter 33 to generate the rotation torque in the rotation direction opposite to the rotation direction of the output shaft. The inverter 33 is controlled in the normal control mode and the power generation control mode (normal control and power generation control) of the pre-driver 32 as described later. The pre-driver 32 detects the rotation direction as shown in FIG. 6 similarly to the sensor signal processing part 40. The pre-driver 32 stores a relation between the sensor signal and the rotation direction as shown in FIG. 6.

Since the command signal always includes the finite rotation speed, the rotation control processing part 31 always outputs the torque direction to the pre-driver 32. The pre-driver 32 is thus always in the normal control mode or the power generation control mode. Particularly when the internal combustion engine 300 stops the combustion and the command signal includes the command for stopping the generation of rotation torque, the torque direction is the same as the direction of inertia rotation of the rotor 210 with the crankshaft 330. The pre-driver 32 is thus in the normal control mode. The pre-driver 32 thus forms a motor control part.

As shown in FIG. 4, the inverter includes switches 34 to 39, which correspond to the stator coils 224 to 226, respectively. The switches 34 to 39 are N-channel MOSFETs, which are switching elements. Between the positive terminal and the negative terminal of the power supply source, U-phase switches 34 and 35 are connected in series, V-phase switches 36 and 37 are connected in series and W-phase switches 38 and 39 are connected in series. A pair of the U-phase switches 26 and 37, a pair of the V-phase switches 36 and 37 and the W-phase switches 38 and 39 are connected in parallel. One end of the U-phase stator coil 224 is connected to a midpoint between the U-phase switches 34 and 35. One end of the V-phase stator coil 225 is connected to a midpoint between the V-phase switches 36 and 37. One end of the W-phase stator coil 226 is connected to a midpoint between the W-phase switches 38 and 39. The other ends of the stator coils 224 to 226 are connected to a common point so that the stator coils 224 to 226 are connected in a Y-shape. For adjusting generation of rotation torque, low-side switches 35, 37 and 39, which are at a low-potential side (negative terminal side) of the power supply source, are PWM-controlled by the pre-driver 32. Duty ratios, which determine on-periods of the low-side switches 35, 37 and 39, respectively, is calculated by the rotation control processing part 31 based on the rotation speed information included in the command signal. Those duty ratios are included in the control information CTL. The duty ratio is assumed to be a fixed value, 100%, for simplicity.

The sensor signal processing part 40 digitizes the detection signals, which are outputted from the rotation angle sensor 60 and correspond to the rotation angle of the output shaft of the motor 200, and generates the sensor signal in the digital form. The sensor signal processing part 40 generates the rotation angle signal and the rotation direction signal based on the digitized sensor signal. The sensor signal processing part 40 further calculates the rotation speed. As shown in FIG. 2, the rotation angle sensor 60 includes three Hall elements 61, 62 and 63 as sensor elements. The Hall elements 61 to 63 are positioned above the permanent magnets 212 of the rotor 210. As described above, the magnetic fluxes generated by the permanent magnets 212 periodically change at every rotation of 90° in mechanical angle (360° in electrical angle) of the rotor 210.

Figure 3:
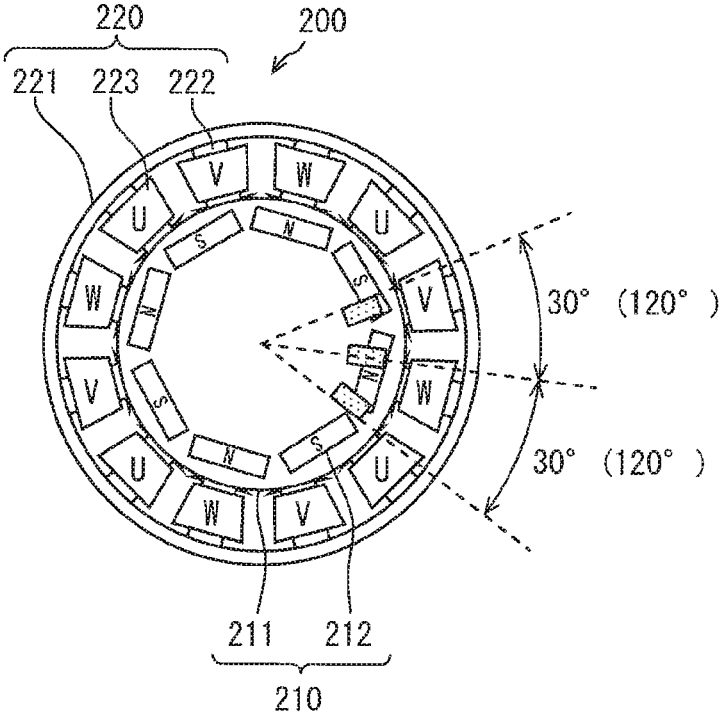
FIG. 3 is a sectional view showing an arrangement of a rotation angle sensor in the motor.
Figure 5:
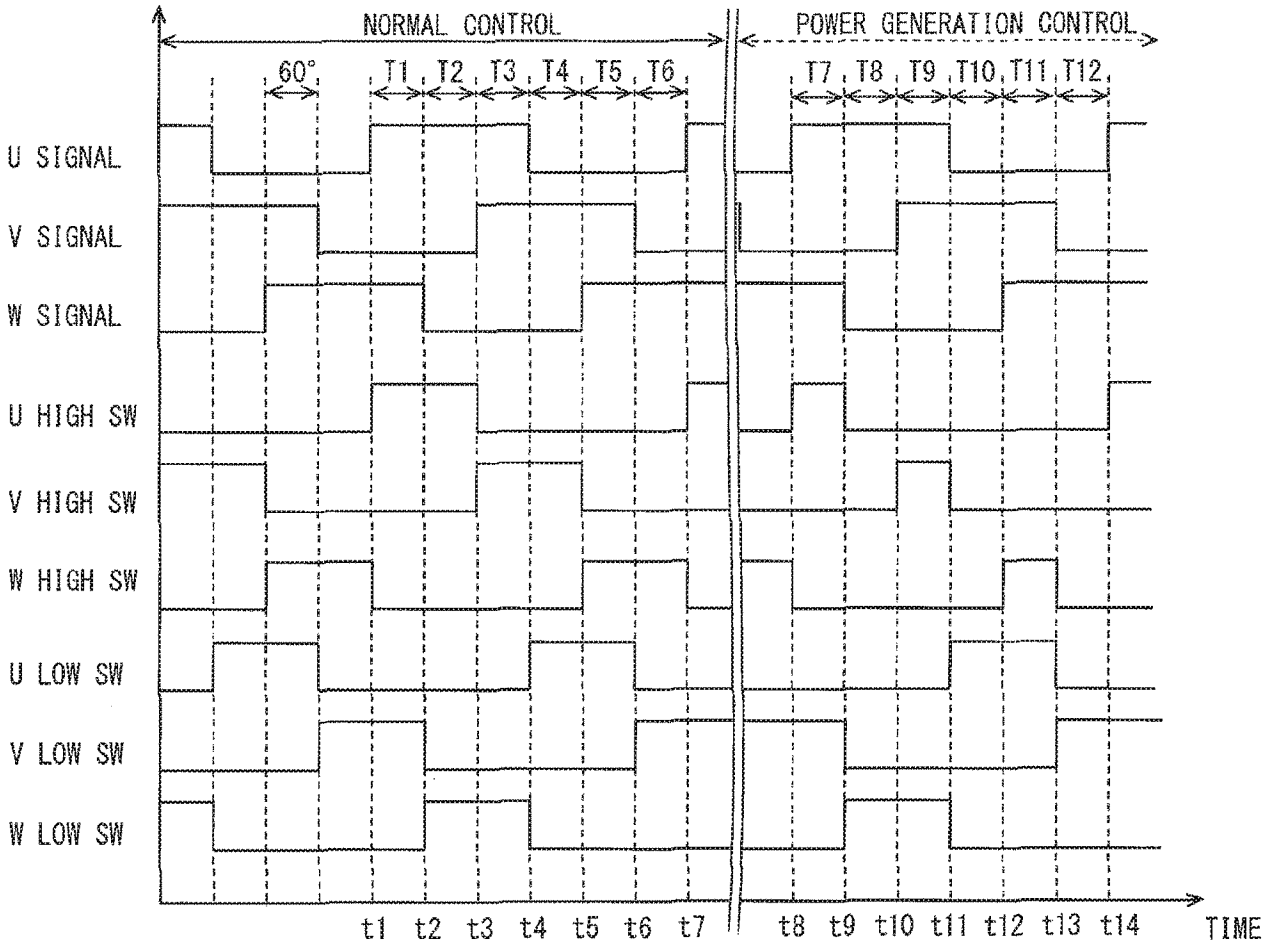
FIG. 5 is a timing chart showing a relation between a sensor signal and a control signal.
Figure 8:
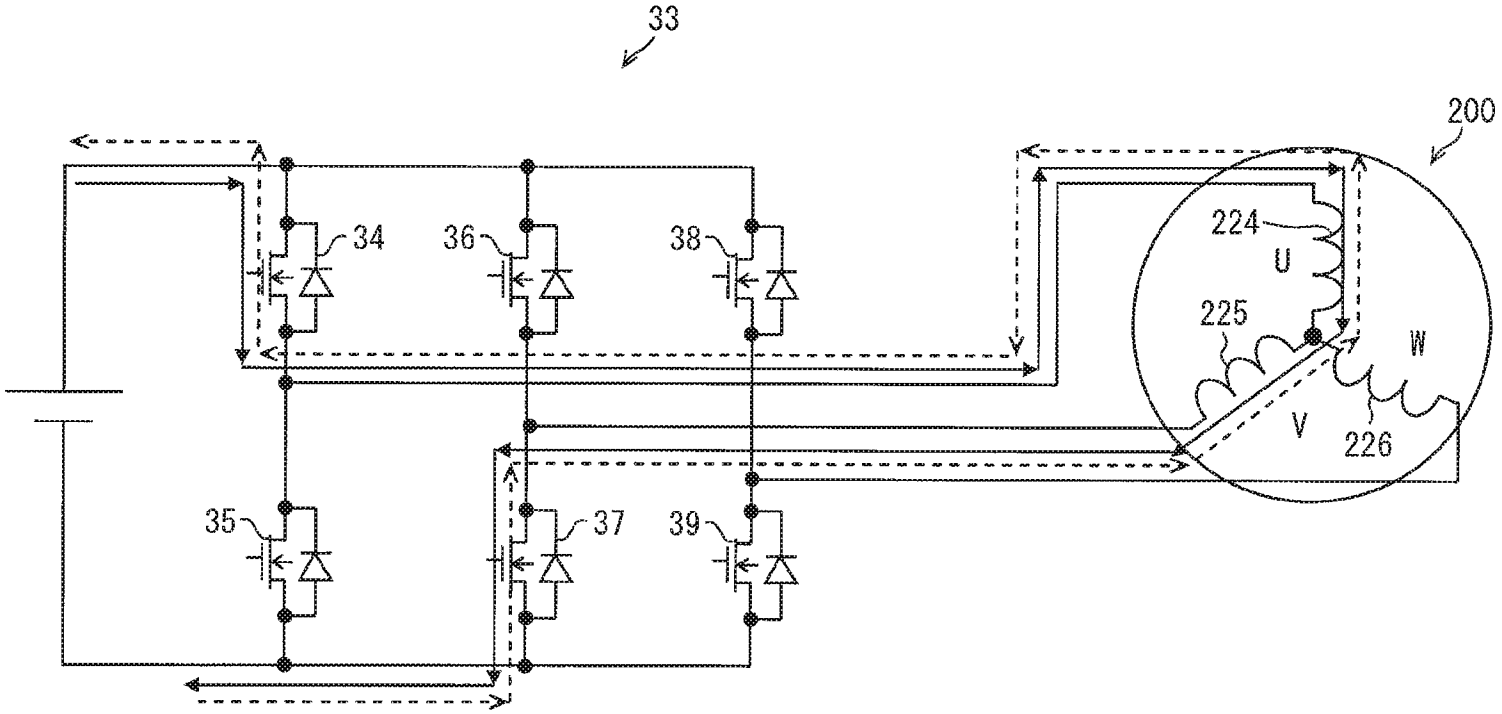
FIG. 8 is a schematic diagram showing a current, which flows in the inverter and the stator coil under normal control.
Figure 10:
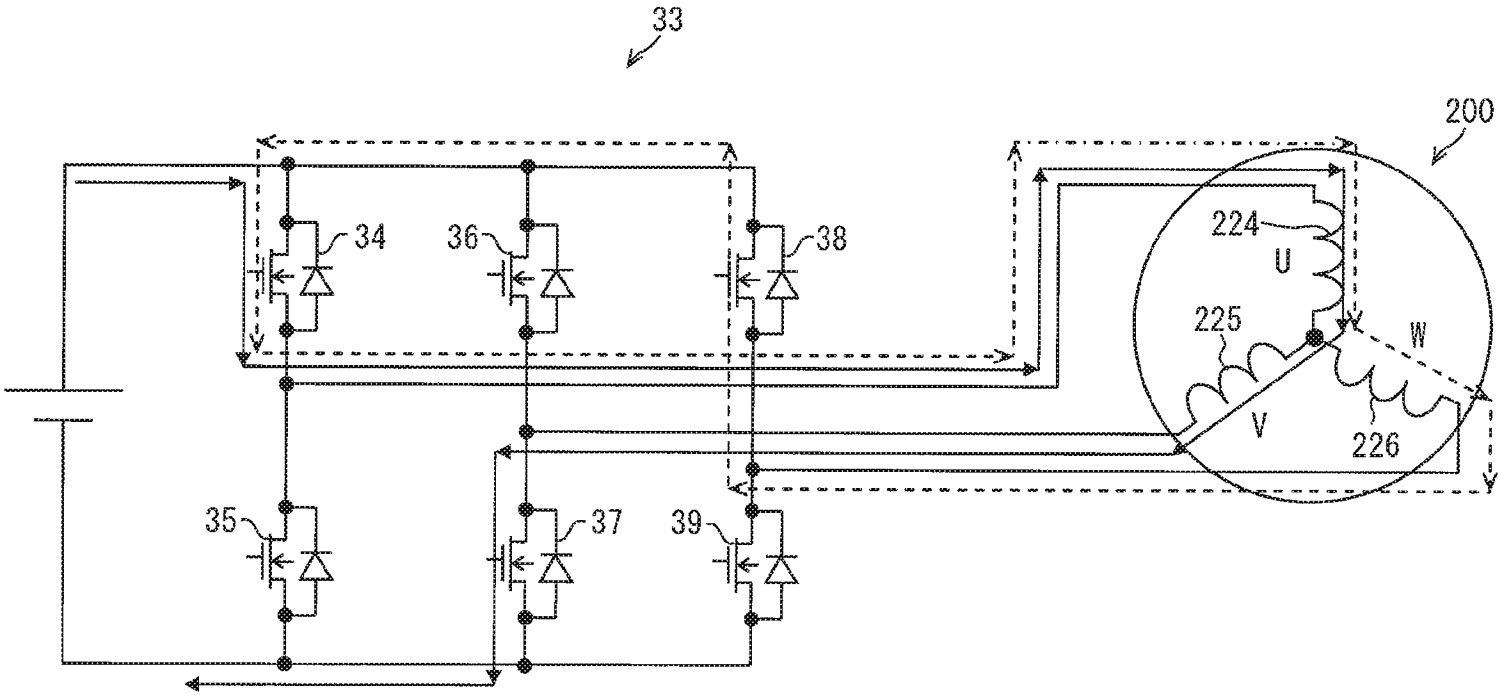
FIG. 10 is a schematic diagram showing the current, which flows in the inverter and the stator coil under power generation control.

As a result, when the rotor 210 rotates 90° in mechanical angle, the direction of magnetic flux, which passes the Hall elements 61 to 63, is reversed. As shown in FIG. 2 and FIG. 3, the Hall elements 61 to 63 are provided with an angular interval of 30° in mechanical angle (120° in electrical angle) around the axis of the rotor 210. As a result, the magnetic fluxes of the permanent magnets 212, which pass the Hall elements 61 to 63, are shifted 120° in electrical angle and the phases of the detection signals outputted from the Hall elements 61 to 63 are also shifted 120°. Those three detection signals are digitized by the sensor signal processing part 40 and a U-phase sensor signal (U signal), a V-phase sensor signal (V signal) and a W-phase sensor signal (W signal) are generated in pulse shapes as shown in FIG. 5. The rotation angle in FIG. 5 to FIG. 7 and FIG. 9 are indicated as electrical angles and, in the following description, the rotation angles are indicated as electrical angles unless otherwise specified. The sensor signals described above are rotation signals. The sensor signal processing part 40 and the rotation angle sensor 60 form a rotation angle detection part.

The sensor signals have the same waveforms such that voltage levels change from high (Hi) levels to low (Lo) levels or from Lo levels to Hi levels each time the rotor 210 rotates 180°, respectively. The sensor signals are shifted 120° in phase one another. As a result, as shown in FIG. 5 and FIG. 6, either one of the voltage levels of the U-phase sensor signal, the V-phase sensor signal and the W-phase sensor signal changes each time the rotor 210 rotates 60°.

The rotation angle signal described above is a pulse signal, which changes its voltage level for a predetermined period and restores its preceding level each time at least one of the voltage levels of the sensor signals changes. The rotation angle signal changes its voltage level from the Hi level to the Lo level when the voltage level of the sensor signal changes from the Hi level to the Lo level or from the Lo level to the Hi level. After the predetermined period, the voltage level returns to the Hi level from the La level. That is, each time the output shaft rotates 60°, the pulse included in the rotation angle signal falls. It is thus possible to detect 60° rotation of the motor 200 by detecting a falling edge of the pulse of the rotation angle signal. The rotation speed of the motor is thus detected by detecting the number of pulses (number of falling edges) of the rotation angle signal per unit time.

The rotation direction signal is a pulse signal, a voltage level of which is fixed to Hi level or La level in accordance with a change pattern of voltage levels of the sensor signals. For fixing the voltage level of the rotation direction signal, the sensor signal processing part 40 needs to detect the rotation direction of the motor 200. The rotation direction of the motor 200 is detected based on a table of correspondence relation shown in FIG. 6. The sensor signal processing part 40 stores a relation of correspondence shown in FIG. 6, which shows the change patterns of the sensor signals relative to the rotation angle of the motor 200. The sensor signal processing part 40 checks how the voltage levels of the sensor signals change in a process of time elapse from time t1 to time t7 (from period T1 to period T6) as shown in FIG. 5 and FIG. 6. For example, as shown in FIG. 6, when the voltage levels of the U-phase signal, the V-phase signal and the W-phase signal change from Hi, Lo and Hi in the period T1 to Hi, Lo and Lo in the period T2, respectively, the sensor signal processing part 40 determines that the motor 200 is rotating in the normal direction. When the voltage levels of the U-phase signal, the V-phase signal and the W-phase signal change from Hi, Lo and Hi in the period T1 to La, La and Hi in the period T2, respectively, the sensor signal processing part 40 determines that the motor 200 is rotating in the reverse direction. As described above, the sensor signal processing part 40 determines that the motor 200 is rotating in the normal direction when a combination of the voltage levels of the sensor signals changes from the left side to the right side with elapse of time as indicated with a solid arrow line in FIG. 6. The sensor signal processing part 40 determines that the motor 200 is rotating in the reverse direction, that is, oppositely to the normal direction, when the combination of the voltage levels of the sensor signals changes from the right side to the left side with elapse of time as indicated with a dotted arrow line in FIG. 6. The sensor signal processing part 40 determines the voltage level of the rotation direction signal RD based on the signal level changes described above.

The state check part 50 generates a state signal, a duty ratio of which varies in accordance with the rotation-state of the motor 200. The state check part 50 generates a state signal of a first duty ratio when the voltage levels of the sensor signals change. The state check part 50 generates a state signal of a second duty ratio, which is different from the first duty ratio, when the voltage levels of the sensor signals do not change and remain at fixed levels. In the present embodiment, the first duty ratio is 80% and the second duty ratio is 90%. The first duty ratio indicates that the motor 200 is in the rotation state and the second duty ratio indicates that the motor 200 is in the stop state. This state signal is inputted to the electronic control unit 10. The electronic control unit 10 checks whether the motor 200 is in the rotation state or the stop state based on the duty ratio of the state signal.

The state check part 50 performs other checks, which are different from the rotation state of the motor 200. That is, the state check part 50 checks a state of the sensor signal, a state of the motor control part 30 and a state of a command signal line 90. For example, the voltage level of the W-phase sensor signal occasionally becomes fixed although the voltage levels of the U-phase sensor signal and the V-phase sensor signal change. In this case, the state check part 50 determines that the third Hall element 63, which generates the W-phase sensor signal, or the third sensor line 96, which connects the third Hall element 63 and the sensor signal processing part 40, is short-circuited to the positive terminal of the power supply source or grounded, and generates a state signal of a third duty ratio (40%). Further, the state check part 50 determines that the motor control part 30 is abnormal or at least one of the stator lines 97 to 99 is short-circuited to the positive terminal of the power supply source or grounded, when at least one of voltage levels of the rotation currents supplied to the stator coils 224 to 226 through the stator lines 97 to 99 remains fixed. In this case, the state check part 50 generates a state signal of a fourth duty ratio (60%). Furthermore, when the voltage level of the command signal line 90 becomes fixed, for example, the state check part 50 determines that the command signal line 90 is short-circuited to the positive terminal of the power supply source or grounded and generates a state signal of a fifth duty ratio (100%). The electronic control unit 10 checks not only the rotation state of the motor 200 but also the state of the sensor signal, the state of the motor control part 30 and the state of the command signal line 90.

The normal control will be described next. The pre-driver 32 sets the rotation direction (actual rotation direction) of the rotor 210 and the direction of rotation torque (torque direction) of the rotor 210 generated by the inverter 33 to coincide in the normal control. That is, the pre-driver 32 sets the torque direction to promote the rotation of the rotor 210. In this control, as shown in FIG. 7, the U-phase high side switch (U high SW) 34, the V-phase high side switch (V high SW) 36 and the W-phase high side switch (W high SW) 38, which are connected to the positive terminal side of the power supply source, are turned on over rotation angle intervals from 0° to 120°, from 120° to 240° and from 240° to 360°, respectively. Further, the V-phase low side switch (V low SW) 37, the W-phase low side switch (W low SW) 39 and the U-phase low side switch (U low SW) 35, which are connected to the negative terminal side of the power supply source, are turned on over rotation angle intervals from 300° to 60°, from 60° to 180° and from 180° to 300°, respectively. The pre-driver 32 thus sequentially turns on the high side switches 34, 36 and 38, which are connected to the positive terminal side of the power supply source, and the low side switches 35, 37 and 39, which are connected to the negative terminal side of the power supply source, over a period, in which the motor 200 rotates 360°. With this control, two of the stator coils 224 to 226 are connected in series to the positive terminal side and the negative terminal side of the power supply source so that the rotation current flows in the stator coil 220. As a result, the rotation torque is generated in the rotor 210 and rotates the output shaft of the motor 200. As described above, each of the low side switches 35, 37 and 39 is controlled by pulse-width modulation in actuality in accordance with a deviation of the present rotation speed from the target rotation speed. However, the low side switches 35, 37 and 39, which are controlled, are assumed to be always in the on-states for simplicity of description.

When the switches 34 and 37 are turned on over the rotation angle interval of the motor 200 from 0° to 60°, for example, the stator coils 224 and 225 are connected in series to the positive terminal and the negative terminal of the power supply source through the switches 34 and 37. As a result, as indicated by the solid arrow line in FIG. 8, a current flows from the positive terminal to the negative terminal of the power supply source in accordance with the voltage of the power supply source. Since the actual rotation direction of the motor 200 coincides the torque direction, the stator coils 224 and 225 generate counter-electromotive forces in directions opposite to the voltage of the power supply source. In this case, as indicated by the dotted arrow line in FIG. 8, a current caused by the counter-electromotive force flows from the negative terminal to the positive terminal of the power supply source. Since the two currents thus flow in the switches 34 and 37 in the opposite directions, no excessive current flows in the switches 34 and 37 and no overheat is generated.

The power generation control will be described next. The pre-driver 32 sets the actual rotation direction and the torque direction of the rotor 210 to be different in the power generation control. That is, the pre-driver 32 sets the torque direction to impede the rotation of the rotor 210. In this control, as indicated by a dotted rectangle in FIG. 9 and differently from the normal control shown in FIG. 7, all of the high side switches 34, 36 and 38, which are connected to the positive terminal side of the power supply source, are turned off over rotation angle intervals from 60° to 120°, from 180° to 240° and from 300° to 360° of the motor 200. As a result, the rotation current does not flow in the stator coils 224 to 226 in accordance with the voltage of the power supply source over the angle intervals described above and the rotation torque corresponding to the rotation current is not generated in the rotor 210. However, as described above, the output shaft of the motor 200 is coupled to the crankshaft 330 via the rotation control processing part 310. For this reason, the output shaft of the motor 200 is rotated by the crankshaft 330 so that the rotation angle changes over the rotation angle interval from 0° to 60°, from 120° to 180° or from 240° to 300°. In this angle range, one of the high side switches 34, 36 and 38, which are connected to the positive terminal side of the power supply source, is turned on and one of the low side switches 35, 37 and 39, which are connected to the negative terminal side of the power supply source is turned on. Thus the rotation current flows in the stator coils 224 to 226 and the rotation torque is generated in the rotor 210.

No current is supplied in the stator coils 224 to 226 as described above for the following reasons. When the switches 34 and 37 are turned on over the rotation angle interval of the motor 200 from 0° to 60°, for example, the stator coils 224 and 225 are connected in series to the positive terminal side and the negative terminal side of the power supply source through the switches 34 and 37. As a result, as indicated by the solid arrow line in FIG. 10, a current flows from the positive terminal to the negative terminal of the power supply source in correspondence to the power supply source voltage. In this case, since the actual rotation direction and the torque direction of the motor 200 differ, the counter-electromotive force is generated in the U-phase stator coil 224 in the same direction as that of the power supply source voltage. For this reason, as indicated by the dotted arrow line in FIG. 10, the current flows from the U-phase high side switch 34 to the W-phase high side switch 39 through the stator coils 224 and 226 based on the counter-electromotive force. Since the flow directions of two currents, which flow in the U-phase high side switch 34, are the same, an excessive current flows in the U-phase high side switch 34 and excessive heat is likely to be generated. Such excessive heat generation is likely to arise similarly in the high side switches 36 and 38.

In the power generation control, which differentiates the actual rotation direction and the torque direction of the motor 200, each of the high side switches 34, 36 and 38 is likely to generate heat excessively. To counter this problem, as described above, the high side switches 34, 36 and 38 are turned off over specified angle ranges, respectively, so that each of the high side switches 34, 36 and 38 has a time period, in which no current flows. Thus overheating of the high side switches 34, 36 and 38 is suppressed.

Figure 11:
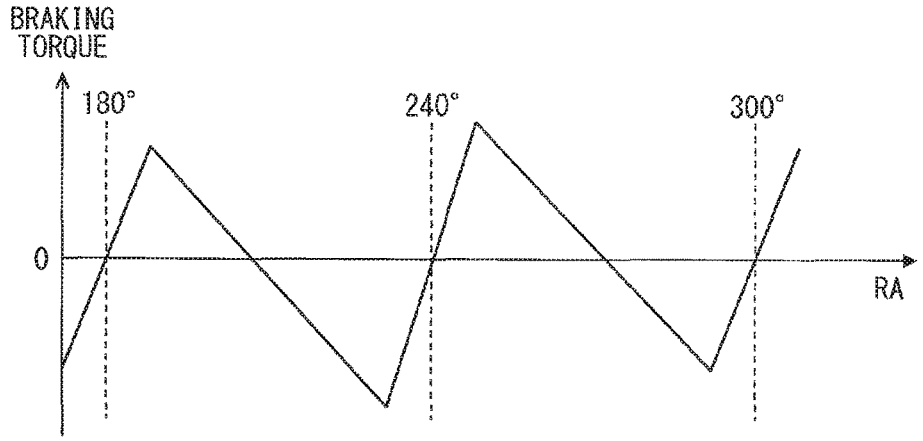
FIG. 11 is a chart showing schematically a braking torque.

However, this heat generation control is likely to cause the following problems. As shown in FIG. 2, the rotor 210 has plural permanent magnets 212 and the stator coil 223, which is wound about the salient pole 222, is provided around the permanent magnets 212. When no rotation current flows in the stator coil 223, no rotation torque is generated in the rotor 210. However, magnetic force is generated between the permanent magnets 212 and the stator coil 223. This magnetic force exerts on the rotor 210 as a braking torque to impede the rotation of the rotor 210. The braking torque caused by the permanent magnets 212 varies relative to the rotation of the rotor 210 as shown in FIG. 11. This braking torque becomes 0 when the stator coil 223 (salient protrusion 222) and the N-pole or the S-pole of the permanent magnets 212 oppose each other. However, when the rotor 210 rotates and its N-pole or the S-pole is displaced from the position of opposing to the protrusion 222, the braking torque is generated to counter the displacement. Because of the magnetic force described above, the torque is generated to promote the rotation of the rotor 210. Since the torque, which is generated in the direction to impede the rotation of the rotor 210, is problematical, this torque is reduced in the present embodiment as follows.

Figure 12:
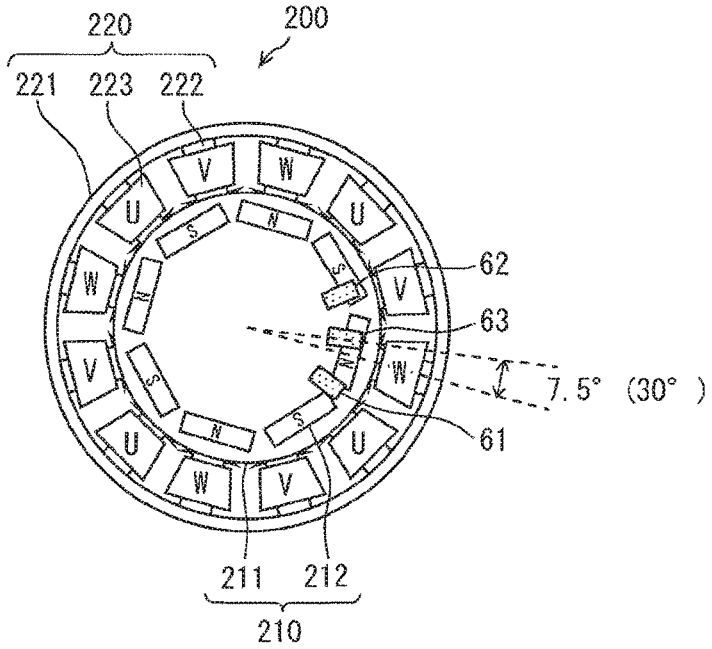
FIG. 12 is a sectional view of the motor showing a positional relation between the rotation angle sensor and the stator coil.
Figure 13:
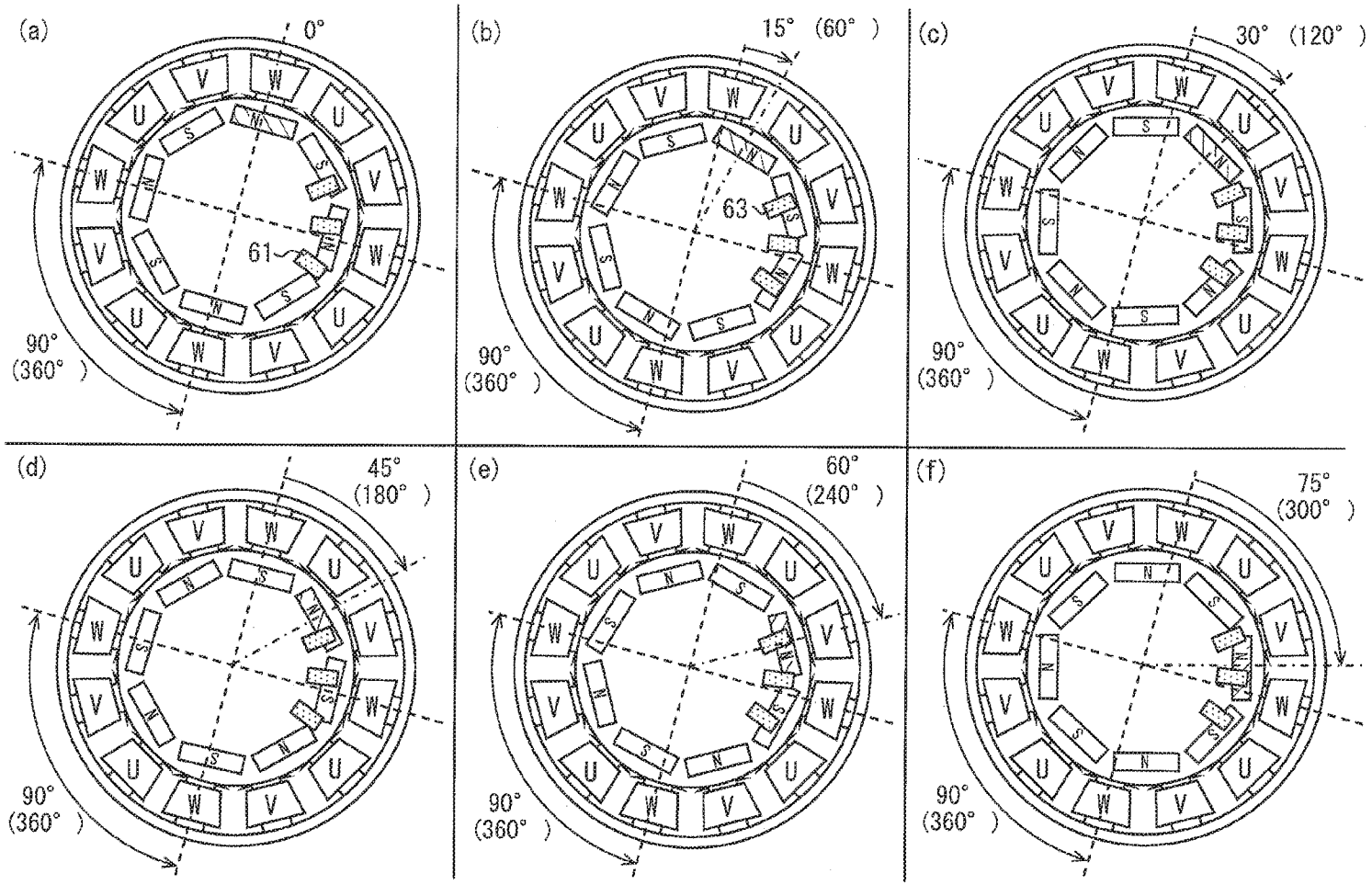
FIG. 13 is an illustration showing positional relations of the rotation angle sensor and permanent magnets relative to the rotation angle of a rotor of the motor.

As shown in FIG. 12, the third Hall element 63, which is located in the middle among the Hall elements 61 to 63 in the circumferential direction, is provided at a position shifted angularly by 7.5° in mechanical angle (30° in electrical angle) from the salient pole 222, which is closest to itself. As a result, in the state that four N-poles of the permanent magnets 212 oppose the salient poles 222 as shown in (a) of FIG. 13, the first Hall element 61 is positioned between the N-pole and the S-pole and the output level of the first Hall element 61 changes from the Hi level to the Lo level or from the Lo level to the Hi level. When the rotor 210 rotates 60° and four S-poles of the permanent magnets 212 are positioned to oppose the salient poles 222 as shown in (b) of FIG. 13, the third Hall element 63 is positioned between the N-pole and the S-pole with a change in its output level. Each time the rotor 210 rotates 60° further and four N-poles or S-poles of the permanent magnets 212 are positioned to oppose the salient poles 222 as shown in (c) to (f) of FIG. 13, one of the Hall elements 61 to 63 is positioned between the N-pole and the S-pole with a change in its output level. Each time the rotor 210 thus rotates to 60°, 120°, 180°, 240°, 300° and) 360° (0°), the N-pole or the S-pole of the permanent magnets 212 opposes the salient pole 222 and the braking torque becomes 0. At those six rotation angles, the output level of one of the Hall elements 61 to 63 is reversed.

Figure 14:
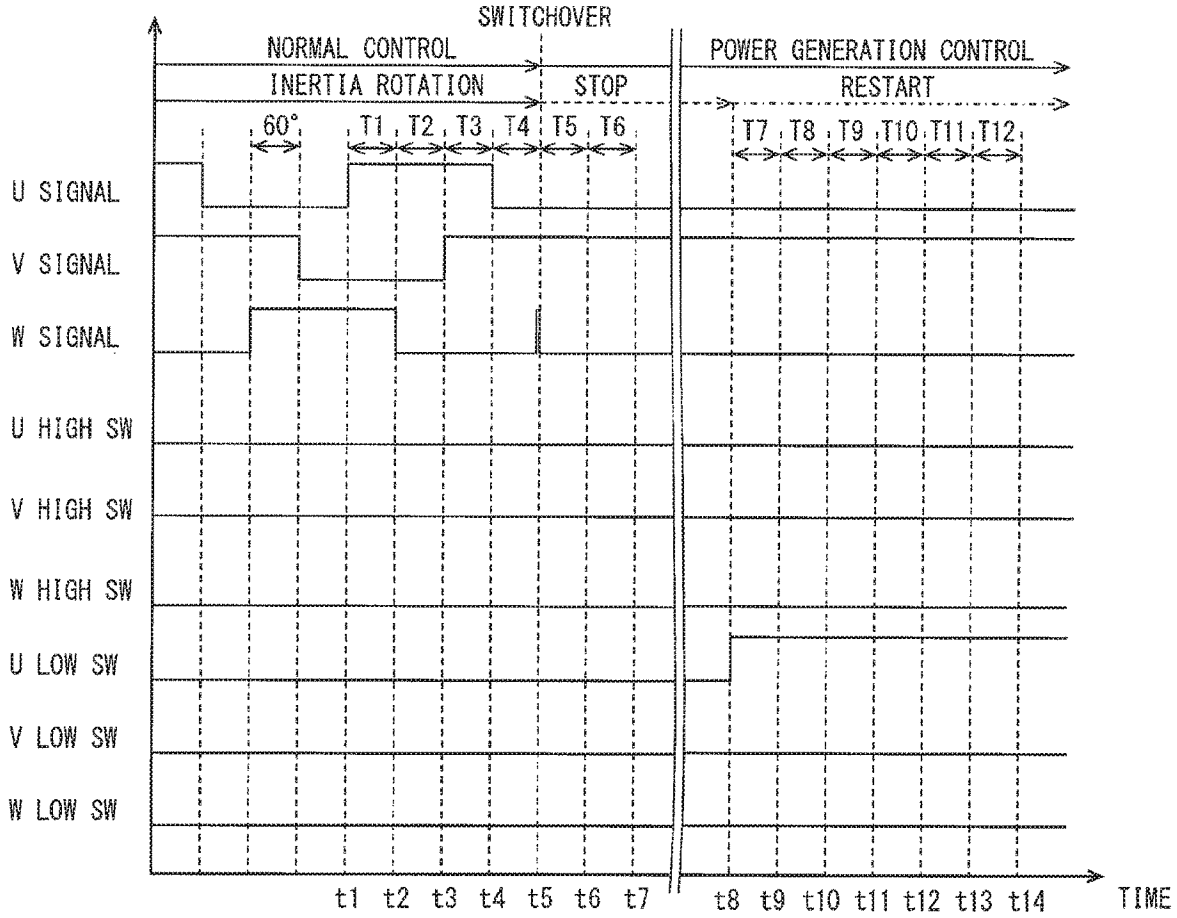
FIG. 14 is a timing chart showing a case that the motor cannot be restarted as a result of a mode switchover by the braking torque.

As described above, the output shaft of the motor 200 is rotated by the crankshaft 330. However, when the internal combustion engine 300 stops its combustion, the rotation of the output shaft of the motor 200 is reduced with the decrease in the rotation speed of the crankshaft 330. When the rotation is decreased almost to stop, the rotor 210 is likely to rotate in reverse momentarily because of the braking torque and then stop in a manner that the N-pole or the S-pole opposes the salient pole 222. In this case, when the rotor 210 restores its rotation direction after the output level of the Hall element 63 is changed as shown in FIG. 14, the sensor signal processing part 40 and the pre-driver 32 determines that the rotor 210 rotated in reverse. The pre-driver 32 thus determines that the actual rotation direction and the torque direction of the motor 200 are different and switches over the operation mode from the normal control mode to the power generation control mode thereby finishing its operation. As described above, the pre-driver 32 supplies no rotation current to the stator coils 224 to 226 in the predetermined angular range in the power generation control mode. When the motor 200 stops in the rotation angle range from 180° to 240° as shown in FIG. 14, for example, the pre-driver 32 outputs the control signal, which corresponds to this angular range, to the switches 34 to 39 at the time of restarting. In this case, since all of the high side switches 34, 36 and 38, which are arranged at the positive terminal side of the power supply source, are controlled to turn off as shown in FIG. 9, no rotation current flows in the stator coils 224 to 226. For this reason, no rotation torque is generated in the rotor 210 and the rotor 210 does not rotate.

Figure 15:
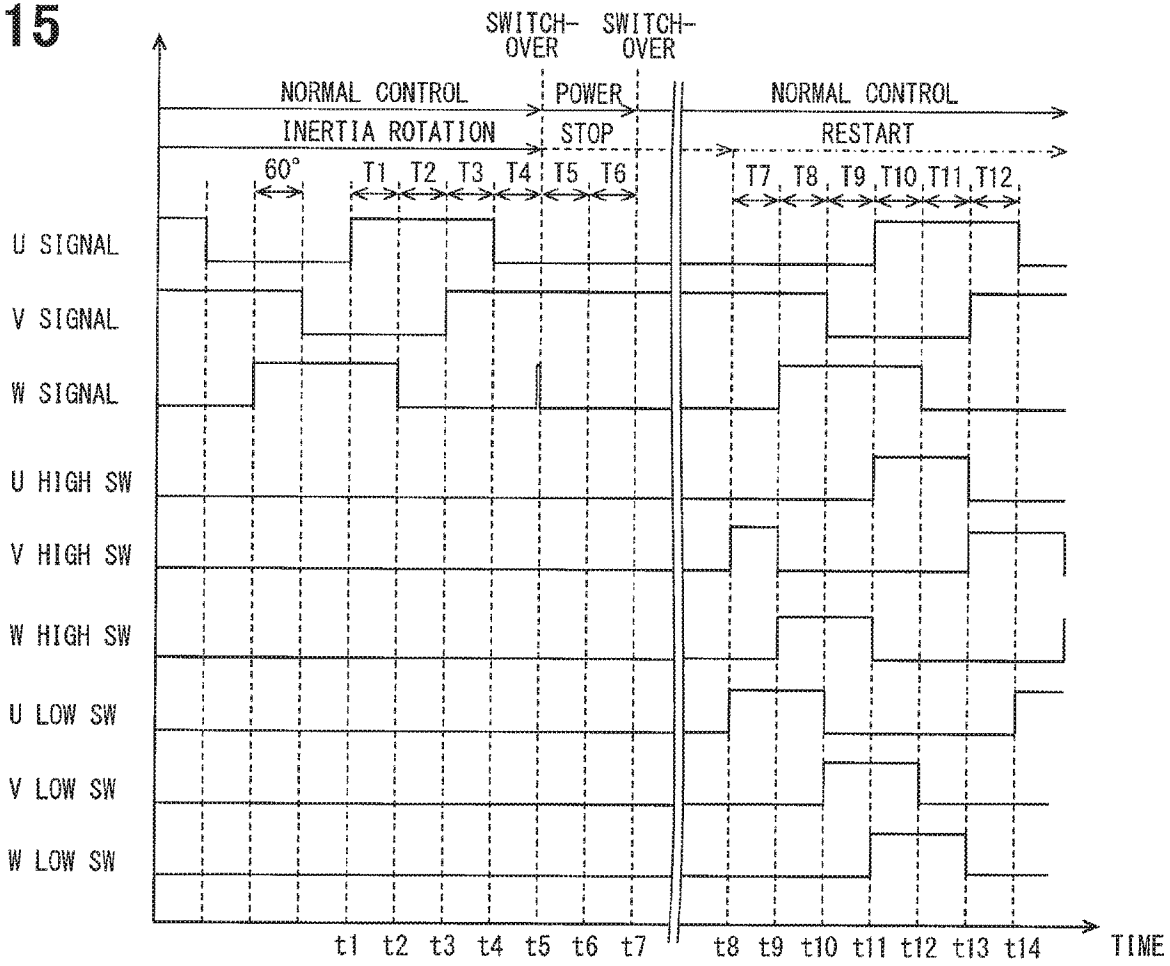
FIG. 15 is a timing chart showing a case that the motor can be restarted in spite of the mode switchover by the braking torque.

The pre-driver 32 checks whether the sensor signal outputted from the sensor signal processing part 40 is fixed after switchover from the normal control mode to the power generation control mode. When the motor 200 is in rotation with the crankshaft 330, the voltage level of the sensor signal changes even when the rotation is reversed. When the rotation of the motor 200 stops after being reversed temporarily because of the braking torque, however, the voltage level of the sensor signal remains fixed as shown in FIG. 14 and FIG. 15. The pre-driver 32 therefore checks whether the sensor signal remains fixed after the switchover from the normal control mode to the power generation control mode. The pre-driver 32 maintains the power generation control mode when the voltage level of the sensor signal changes. When the voltage level of the sensor signal remains fixed, however, the pre-driver 32 switches over from the power generation control mode to the power supply mode as indicated at time t7 in FIG. 15. As described above, the pre-driver 32 supplies the rotation current to the stator coils 224 to 226 over all angular ranges of the rotor 210 in the normal control mode. Thus, as indicated at time t8 in FIG. 15, the rotation current flows in the stator coils 224 to 226 at the restart time thereby to rotate the rotor 210.

Figure 16:
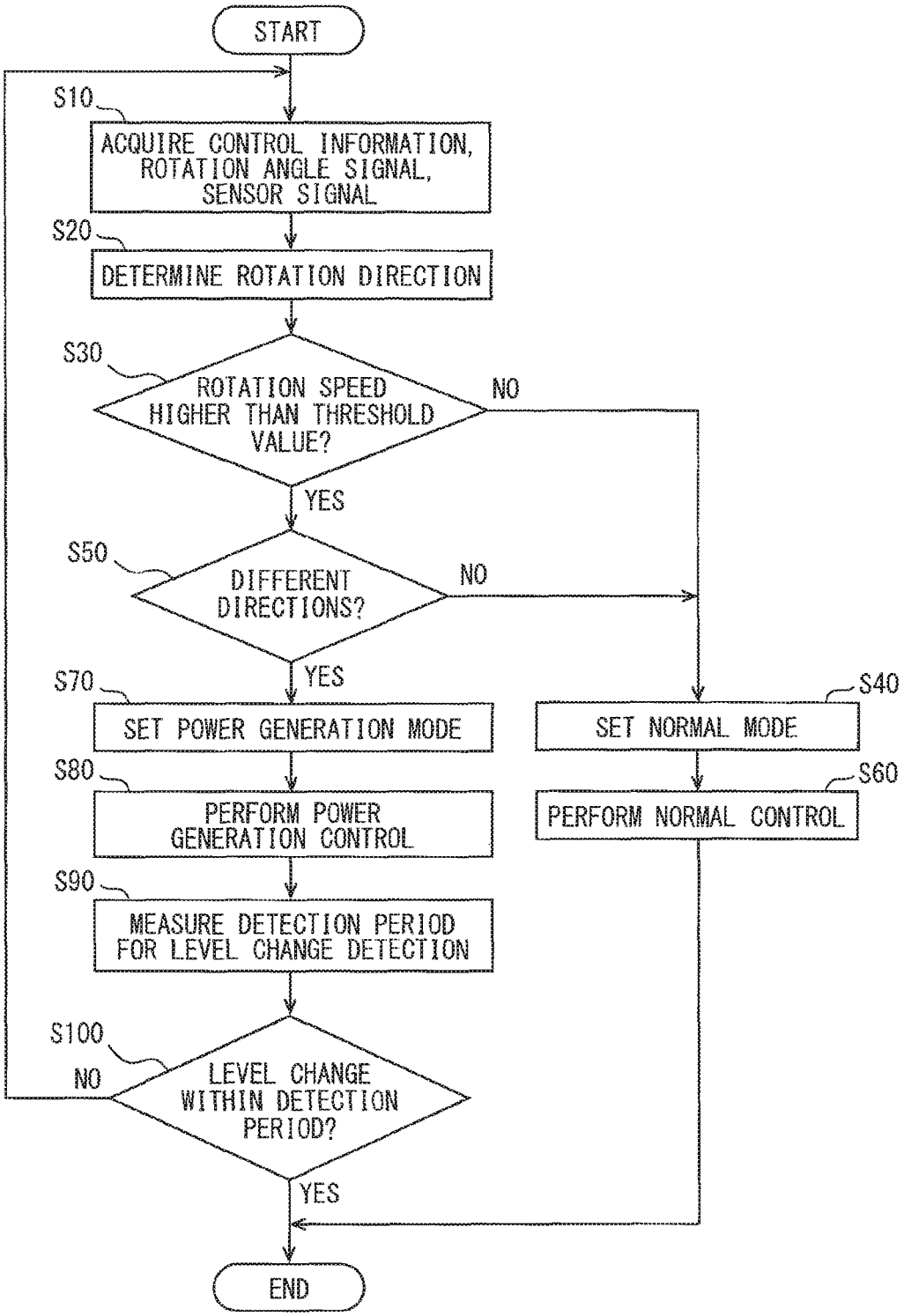
FIG. 16 is a flowchart showing pre-driver control processing.

Control processing of the pre-driver 32 will be described next with reference to FIG. 16. The pre-driver 32 first acquires, at step S10, the control information CTL inputted from the rotation control processing part 31 and the rotation angle signal RA of the rotor 210 and the sensor signal SNR inputted from the sensor signal processing part 40. The pre-driver 32 then executes step S20.

The pre-driver 32 determines the rotation direction of the rotor 210 based on the acquired sensor signal and the relation shown in FIG. 6. The pre-driver 32 then executes step S30.

The pre-driver 32 checks at step S30 whether the rotation speed included in the acquired rotation angle signal is higher than a stored threshold value. That is, the pre-driver 32 checks whether the rotation speed of the rotor 210 is sufficiently high to perform the power generation control. The pre-driver 32 executes step S40 when the rotation speed is equal to or lower than the threshold value (NO at step S30). The pre-driver 32 executes step S50 when the rotation speed is higher than the threshold value (YES at step S30).

When the rotor 210 stops after momentarily rotating in reverse because of the braking torque, the signal changes momentarily. The pre-driver 32 therefore determines that the rotation speed is sufficiently higher than the threshold value. When the rotor 210 momentarily rotates in reverse because of the braking torque, the pre-driver 32 executes step S50.

The pre-driver 32 sets the operation mode to the normal control mode at step S40 and then executes step S60. The pre-driver 32 performs the normal control at step S60 to generate the rotation torque in the rotor 210 and then finishes this control routine.

At step S50, which is executed when the rotation speed is determined to be higher than the threshold value at step S30, the pre-driver 32 checks whether the rotation direction and the torque direction of the rotor 210 are different. When the rotation direction and the torque direction are the same (NO at step S50), the pre-driver 32 executes step S40 to perform the normal control. When the rotation direction and the torque direction are different (YES at step S50), the pre-driver 32 executes step S70. The pre-driver 32 speeds up the rotation of the rotor 210 by repeating steps S10 to S60 in sequence for performing the normal control.

The pre-driver 32 switches over the operation mode to the power generation control mode at step S70 and then executes step S80.

The pre-driver 32 performs the power generation control at step S80 to generate the rotation torque in the rotor 210. The pre-driver 32 then executes step S90.

The pre-driver 32 measures a predetermined detection time period at step S90 for detecting whether the voltage level of the sensor signal changed. The pre-driver 32 then executes step S100.

The pre-driver 32 checks at step S100 whether the voltage level of the sensor signal changed within the detection time period measured at step S90. When the voltage level of the sensor signal changes within the detection time period (YES at step S100), the pre-driver 32 finishes its operation. The pre-driver 32 slows down the rotation of the rotor 210 by repeating steps S10 to S30, S50, S70 to S100 in sequence for performing the power generation control. When the voltage level of the sensor signal does not change in the detection time period (NO at step S100), the pre-driver 32 executes the above-described steps starting from step S10 again. In a case that the rotor 210 stops after momentarily rotating in reverse because of the braking torque as described above, the rotation speed of the motor 200 is decreased to 0 when step S30 is executed again following step S10. The pre-driver 32 therefore determines that the rotation speed is lower than the threshold value (NO at step S30). As a result, the pre-driver 32 executes step S40 to switch over to the normal control mode and finishes the control routine.

The operation and advantage of the motor control apparatus 100 according to the present embodiment will be described next. As described below, the pre-driver 32 turns off the high side switches 34, 36 and 38 and provides the high side switches 34, 36 and 38 with no-current supply period in the specified rotation angle range. Thus the high side switches 34, 36 and 38 are protected from the excessive current and excessive heat generation.

When the pre-driver 32 determines that the sensor signal does not vary in the detection time period in the power generation control mode, the operation mode is switched over from the power generation control mode and the normal control mode. Thus, even when the braking torque reverses the rotation of the motor 200 momentarily and the pre-driver 32 switches over its operation mode from the normal control mode to the power generation control mode temporarily, the operation mode is switched back to the normal control mode again. As a result, the rotation torque can be generated in the motor 200 by the pre-driver 32 for the rotation of the output shaft of the motor 200 at the time of restarting irrespective of the rotation angle at the time when the motor 200 stops. The cam phase can thus be adjusted to the phase suitable for restarting the engine.

The motor control apparatus 100 described above is not limited to the above-described embodiment but may be implemented with various modifications.

In the present embodiment, when it is determined that the sensor signal does not vary within the detection time period, the pre-driver 32 is exemplified to switch over its operation mode from the power generation control mode to the normal control mode. However, the determination of switchover from the power generation control mode to the normal control mode is not limited to the above-described example. For example, the pre-driver 32 may be configured to switch over its operation mode based on the rotation angle signal. When the motor 200 stops after the momentary reverse rotation caused by the braking torque, the voltage level of the rotation angle signal as the sensor signal become fixed. As a result, the pre-driver 32 may switch over the operation mode from the power generation control mode to the normal control mode when the rotation angle signal is determined as not varying in the detection time period.

In the present embodiment, the pre-driver 32 is exemplified to detect the rotation direction of the motor 200 based on the sensor signal. The pre-driver 32 may be configured to receive the rotation direction of the motor 200 detected by the sensor signal processing part 40.

In the present embodiment, the rotation angle sensor 60 is exemplified as including Hall elements as sensor elements. The sensor element may, however, be other elements, as far as it is a magneto-electric conversion element, which converts a magnetic signal into an electric signal. The number of the sensor elements is exemplified as three. However, the number of the sensor elements may be three or more.

In the present embodiment, the driver 20 is exemplified as including the state check part 50. However, the driver 20 need not necessarily include the state check part 50.

In the present embodiment, the rotation angle signal is exemplified as a pulse signal, which changes its voltage level for the predetermined time period at every change in the voltage level of at least one of the sensor signals and restores its previous level. The rotation angle signal is not limited to such an example. The rotation angle signal may change its voltage level in correspondence to the number of changes in the voltage levels of the sensor signals. In this modified example, the sensor signal processing part 40 stores a relation between the number of changes in the voltage levels of the sensor signals and the voltage levels and outputs the rotation angle signal, which has the voltage level determined by the stored relation, after detecting the number of changes in the voltage level of the sensor signal. Further the electronic control apparatus 10, the rotation control processing part 31 and the pre-driver 32 store relations between the voltage levels of the rotation angle signal and rotations speed, respectively, and detect the rotation speed based on the stored relation and the voltage level of the inputted rotation angle.

Although not described in the present embodiment, the motor control apparatus 100 having the above-described function is suitable for a vehicle, which performs an idling stop operation. In a vehicle, which performs the idling stop operation, an internal combustion engine need be restarted in a short time after the internal combustion engine is stopped. In a case that the operation mode of the pre-driver 32 is forcibly switched over to the normal control mode once after stopping of the internal combustion engine, this switchover processing takes certain time. This switchover processing tends to delay the restarting of the engine within a short time. In the present embodiment, the motor control apparatus 100 maintains the pre-driver 32 in the normal control mode even when the motor 200 stops because of the braking torque. As a result, differently from the comparative example described above, the cam phase can be adjusted to a phase suitable for restarting the internal combustion engine 300 within a short time and hence the internal combustion engine 300 can be restarted within the short time.

What is claimed is:

1. A motor control apparatus for controlling driving of a motor, which is coupled mechanically to a crankshaft and a camshaft of an internal combustion engine through a valve timing conversion unit to adjust a phase of the camshaft relative to the crankshaft, the motor including an output shaft coupled to the valve timing conversion unit, a rotor fixed to the output shaft and having permanent magnets, and a stator provided around the rotor and having a stator coil, the motor control apparatus comprising:

an inverter including plural switching elements for supplying a current to the stator coil to generate magnetic fluxes, which exert on the permanent magnets to generate a rotation torque in the rotor in a direction to promote or impede rotation of the output shaft;

a rotation angle detection part for generating a rotation signal varying with a rotation angle of the motor and a rotation direction of the motor;

a motor control part for controlling the plural switching elements of the inverter to turn on and off based on the rotation signal thereby to control the current flowing in the stator coil and control generation of the rotation torque; and a command part for commanding the motor control part to increase and decrease, wherein the motor control part is configured to operate in a normal control mode when the rotation torque is commanded to promote the rotation of the motor, and a power generation control mode when the rotation torque is commanded to impede the rotation of the motor, the motor control part is configured to supply the current to the stator coil always irrespective of the rotation angle of the motor in the normal control mode, and stop the current from being supplied to the stator coil at every rotation of the motor over a predetermined rotation angular interval in the power generation control mode, and the motor control part is configured to check whether the rotation signal varies in a predetermined time period in the power generation control mode, maintains the power generation control mode upon determination that the rotation signal varies in the predetermined time period, and switches over the operation mode to the normal control mode upon determination that the rotation signal does not vary in the predetermined time period.

2. The motor control apparatus according to claim 1, wherein:

the phase of the camshaft relative to the crankshaft is adjusted by controlling the driving of the motor.

* * * * *